United States Patent [19]

Costanzo

[11] 4,246,675

[45] Jan. 27, 1981

[54] INDUSTRIAL VACUUM APPARATUS

[76] Inventor: Dean V. Costanzo, Lakeport Rd., Chittenango, N.Y. 13037

[21] Appl. No.: 61,372

[22] Filed: Jul. 27, 1979

[51] Int. Cl.[3] ..... A47L 9/24

[52] U.S. Cl. ..... 15/315; 226/181; 242/86

[58] Field of Search ..... 15/314, 315; 226/118, 226/181; 254/175.5; 242/86

[56] References Cited

U.S. PATENT DOCUMENTS

| | | | |
|---|---|---|---|
| 1,683,911 | 9/1928 | Morris | 242/86 X |
| 2,023,955 | 12/1935 | Harvey | 15/315 |
| 2,181,521 | 11/1939 | Reade | 242/86 |
| 2,595,655 | 5/1952 | Hannay | 15/315 X |
| 3,268,933 | 8/1966 | Marantette et al. | 15/315 X |
| 3,626,545 | 12/1971 | Sparrow | 15/339 X |
| 3,958,297 | 5/1976 | Hukuba et al. | 15/315 |
| 3,977,037 | 8/1976 | Miyake et al. | 15/315 |
| 3,977,038 | 8/1976 | Hukuba et al. | 15/315 X |

*Primary Examiner*—Christopher K. Moore
*Attorney, Agent, or Firm*—Charles S. McGuire

[57] ABSTRACT

The flexible hose of an industrial scale vacuum cleaning apparatus is wound upon and unwound from a drum by a reversible motor which drives four rollers tangentially engaging the hose at a point between the drum and the vacuum intake. The rollers preferably comprise small pneumatic tires inflated to a low pressure and the motor control means are located on the operator's handle connected to the vacuum intake head.

12 Claims, 3 Drawing Figures

INDUSTRIAL VACUUM APPARATUS

BACKGROUND OF THE INVENTION

The present invention relates to industrial scale vacuum cleaning apparatus, and more particularly to novel apparatus for supply and take-up of the vacuum hoses of such apparatus.

Vacuum cleaning equipment of the type used, for example, in cleaning buses normally includes a flexible hose several inches in diameter and long enough to reach the length of the bus plus an additional length to communicate with the trash-receiving means and blower outside the bus. Obviously, a hose of such size and length can be quite bulky and awkward to handle, particularly when coupled with the requirement of manipulating the hose and attached vacuum intake head through aisles and between seats of a bus. Thus, the efficiency of the cleaning operation is limited by the physical constraints imposed by the size and bulk of the hose.

It is a principal object of the present invention to provide vacuum cleaning apparatus having means facilitating handling of a relatively large vacuum hose.

More specifically, the object is to provide means for effecting winding and unwinding movement of a flexible hose with respect to a rotatable drum in association with vacuum cleaning equipment wherein reversible controls for the hose drive means are location on the handle of the vacuum intake head.

In a more general sense, the object is to provide novel and improved industrial scale vacuum cleaning equipment.

Other objects will in part be obvious and will in part appear hereinafter.

SUMMARY OF THE INVENTION

In accordance with the foregoing objects, the invention contemplates a vacuum cleaning system including the usual intake head, flexible hose, trash receptacle and blower, and also having drive means for moving the hose axially to wind upon or unwind from a rotatable drum. The drive means comprises a reversible air or electric powered motor having an output shaft connected through suitable gearing to the axles of four roller means, preferably comprising relatively small pneumatic tires inflated to a low pressure. The axles are mounted upon a support plate in a common plane perpendicular to the axis of the hose as it passes through an opening in the plate and is frictionally engaged by the four tires.

The drum carrying the hose is biased toward rotation in the hose winding direction by a counterweight attached to one end of a flexible cable which is wound at the other end about the drum hub. The frictional engagement of the hose by the tires is sufficient to overcome the bias of the counterweight on the drum, whereby the hose pulled from the drum when the motor is actuated to drive the hose outwardly, and held stationary by the frictional engagement when the motor drive is stopped. The motor drive in the disclosed embodiment is controlled by solenoid valves in the compressed air supply line, the position of the valves being responsive to radio signals from a miniature transmitter on the handle which the operator grasps to manipulate the vacuum intake head. Alternatively, an electric motor may be used, also with remote control capability. Push buttons on the handle-mounted control means serve to move the hose in either direction, or hold it stationary.

DETAILED DESCRIPTION

Figure 1:
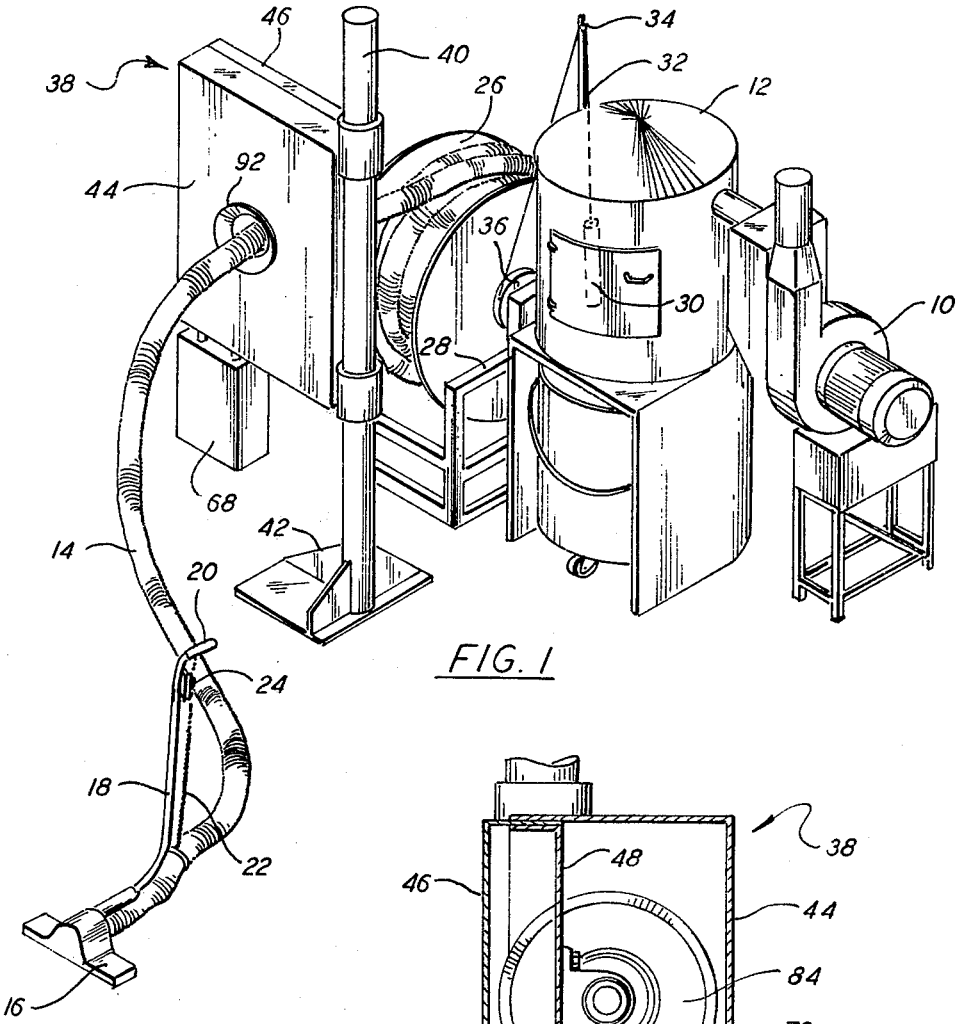
FIG. 1 is a perspective view of industrial vacuum cleaning apparatus embodying the present invention.

Referring now to the drawings, in FIG. 1 is shown vacuum cleaning equipment comprising conventional blower means 10 communicating, through trash receptacle 12 and flexible hose 14, with intake head 16. Handle 18 is attached at one end to intake head 16 and extends to a hand grip 20 from which hose 14 is suspended by a spring or chain 22. Control buttons 24, the function of which will be described later, are also mounted on handle 18 in a convenient location for manipulation by an operator holding hand grip 20.

Hose 14 is of the usual corrugated, flexible construction, having a diameter of, for example, 3 or 4 inches. The hose is wound on drum 26, rotatably mounted upon base 28 and having an axial opening through which the inner end of hose 14 communicates with the interior of trash receptacle 12. Counterweight 30 is attached to one end of flexible cable 32 which passes over pulley 34 and is wound about hub 36 of drum 26. Drum 26 is biased by the cable-counterweight arrangement toward rotation in the direction which winds hose 14 upon the drum.

The drive means by which hose 14 is fed in the forward direction, i.e., unwound from drum 26 thereby winding cable 32 upon hub 36 and raising counterweight 30, and in the rearward direction, i.e., toward drum 26 upon which it is thus wound by rotation of the drum as counterweight 30 lowers, will now be examined in more detail. As seen in FIG. 1, hose 14 passes through housing 38 between intake head 16 and drum 26. Housing 38 is supported on column 40 and base 42, and includes removable front cover 44 and rear section 46.

Figure 3:
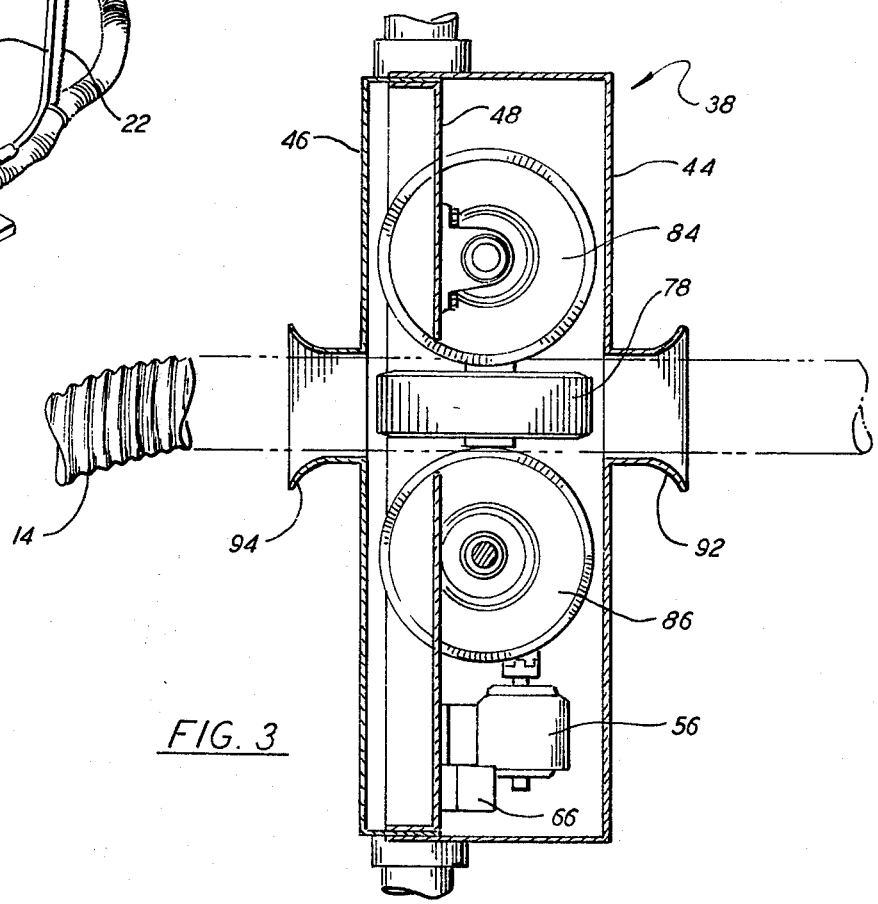
FIG. 3 is a side elevational view in section on the line 3—3 of FIG. 2.
Figure 2:
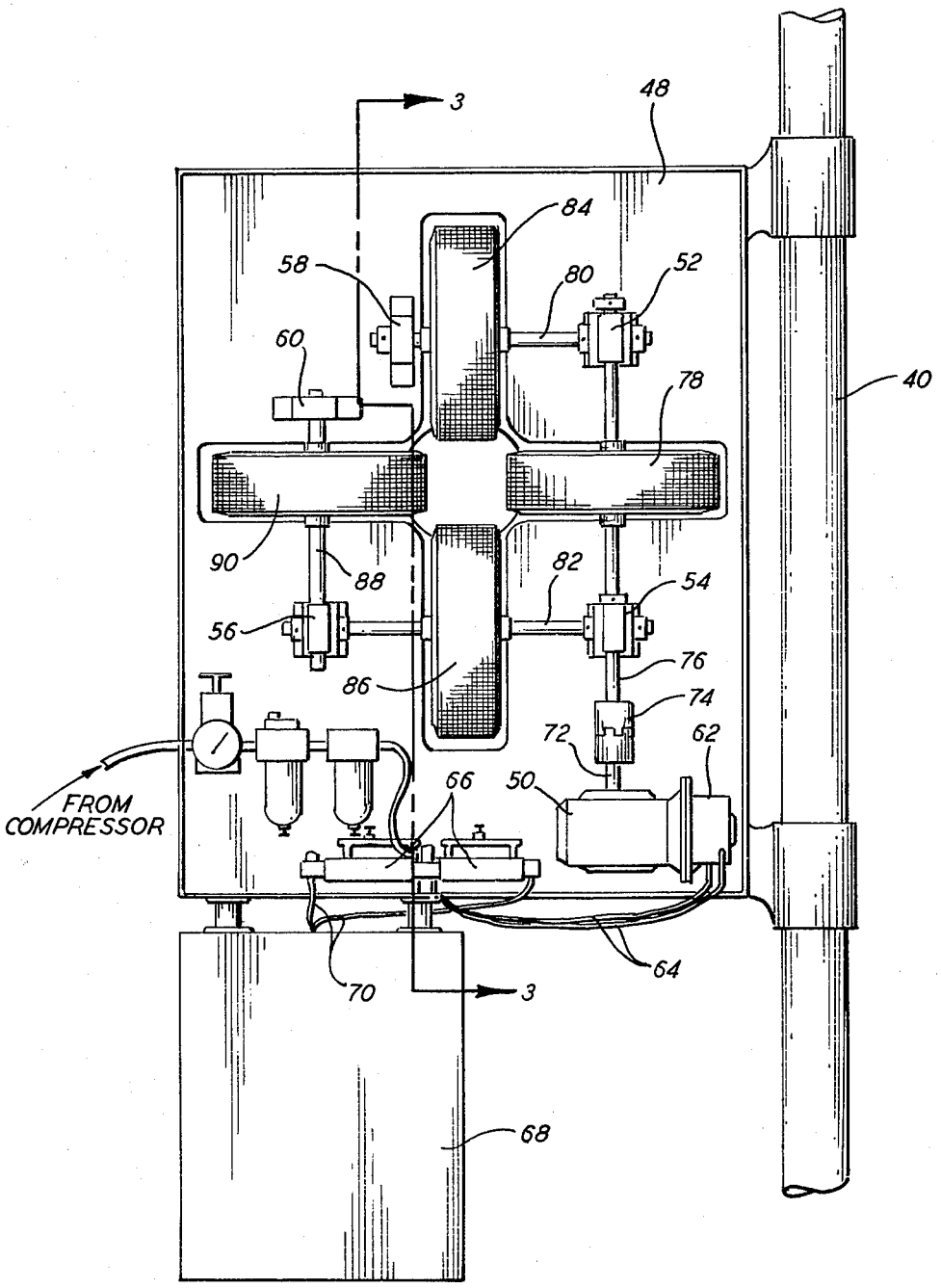
FIG. 2 is a front elevational view of portions of the apparatus of FIG. 1.

Referring now to FIGS. 2 and 3, base plate 48 is supported within housing 38. Mounted upon base plate 48 are gear box 50, transfer gears 52, 54 and 56, and bearing supports 58 and 60. Air motor 62 is driven by compressed air supplied through lines 64 from a compressor (not shown), passing through solenoid operated valves 66 by which the direction of air flow may be reversed or stopped. Control box 68 is suspended from housing 38 and contains conventional electrical components for supplying impulses through electrical connections 70 to the solenoid elements of valves 66 in response to radio or other such signals transmitted from a remote source. In this case, the transmitter is carried on handle 18 and is controlled by aforementioned push buttons 24. Thus, the starting, stopping and direction of rotation of motor 62 is under the direct control of an operator while manipulating vacuum intake head 16. As previously mentioned, an electric motor may be used in place of the disclosed air motor.

Output shaft 72 is connected through coupler 74 to axle 76 which carries pneumatic tire 78. Rotation of axle 76 is transmitted at the same speed through gears 52 and 54 to axles 80 and 82, respectively, which are parallel to one another and perpendicular to axle 76. Tires 84 and 86 are carried on axles 80 and 82, respectively. Rotation of axle 82 is transmitted through gears 56 to perpendicular axle 88, carrying tire 90. Base plate 48 is provided with the required openings to allow portions of tires 78, 84, 86 and 90, as well as hose 14, to pass through the plane thereof. Hose 14 enters and leaves housing 38 through flared tubes 92 and 94. The four tires are so mounted that a circle tangent to all tires at their inwardly facing surfaces is substantially equal or slightly smaller in diameter than hose 14.

Thus, hose 14 is frictionally engaged on its outer surface by the four tires, which are preferably all of the same size, a suitable size being about 10 inches in diameter, and inflated to a relatively low pressure, e.g., 5 psig. Although as few as three tires could be used to maintain the axial position of the hose as it is frictionally engaged and driven thereby, four tires are preferred for ease of motion transfer. The speed of rotation of output shaft 72, and thus of axles 76, 80, 82 and 88, is such that hose 14 is advanced or retracted at a slow walking speed. Thus, an operator holding hand grip 20 may depress the button 24 which causes forward advance of hose 14 and walk into and to the rear of a bus as hose is fed out with virtually no effort on the operator's part. Then, as the cleaning operation progresses, the operator may intermittently push the button 24 which actuates valves 66 to reverse the direction of air supply to motor 62 from that used to feed out the hose. The hose will thus be fed rearwardly by the tires and wound on drum 26 due to rotation thereof by the action of counterweight 30 and cable 32. Thus, the hose will be taken up at the same rate as the cleaning operation progresses, under complete and practically effortless control of the operator.

What is claimed is:

1. Industrial scale vacuum cleaning apparatus comprising, in combination:

(a) an elongated hose having intake and outlet ends;

(b) manually engageable handle means connected to said intake end of said hose;

(c) a rotatable drum upon which said hose may be wound and unwound;

(d) receptacle means with which said outlet end of said hose communicates, for receiving and containing material passing through said hose;

(e) blower means communicating with said receptacle means for creating a vacuum to draw material through said hose from said intake end to said outlet end and thence to said receptacle means;

(f) at least three resilient roller members mounted for rotation about axes in a common plane and having peripheries tangent to a circle substantially equal in circumference to said hose;

(g) said hose passing through said plane with its longitudinal axis normal thereto and frictionally engaged on its outer surface by each of said roller members;

(h) reversible motor means for imparting rotation to all of said roller members at the same speed in either direction for selectively moving said hose toward or away from said drum; and (i) control means mounted upon said handle means for selective actuation by an operator thereof for causing movement of said motor means in either direction.

2. The invention according to claim 1 and further including means applying a continuous biasing force upon said drum toward rotation in the direction of winding said hose thereon, whereby the hose is automatically wound upon said drum as the operator approaches to same.

3. The invention according to claim 2 wherein said biasing means comprises a counterweight and a cable attached at opposite ends to said drum and said counterweight and passing over a pulley system therebetween.

4. The invention according to claim 1 and further including electrical means for operating said motor in either direction in response to actuation of said control means.

5. The invention according to claim 4 wherein said control means comprises a transmitter for remote operation of said electrical means.

6. The invention according to claim 1 wherein said roller members each comprise a pneumatic tire.

7. The invention according to claim 6 wherein each of said pneumatic tires is inflated to a pressure not more than ten pounds above atmospheric.

8. The invention according to claims 6 or 7 wherein said tires are four in number and are mounted for rotation about axes at 90° to each adjacent pair of axes.

9. The invention according to claim 1 wherein said roller members are four in number and are mounted upon individual axles arranged in a square and connected for common rotation in response to direct rotation of one of said axles by said motor means.

10. The invention according to claim 9 wherein said roller members each comprise a pneumatic tire inflated to a pressure not more than ten pounds above atmosphere.

11. The invention according to claim 9 or 10 and further including a unitary, plate-like support member upon which said motor means and all of said roller members are mounted.

12. The invention according to claim 9 or 10 and further including a unitary, plate-like support member upon which said motor means and all of said roller members are mounted, said support member having an opening therein through which said hose and portions of said roller members pass.

* * * * *